US005983531A

United States Patent [19]

Chaigne et al.

[11] Patent Number: 5,983,531

[45] Date of Patent: Nov. 16, 1999

[54] BOOT WITH TIGHTENING DEVICE

[75] Inventors: Jerome Chaigne, Le Mollard; Laurent Marechal, Allee des Symphorines, both of France

[73] Assignee: Salomon S. A., Metz-Tessy, France

[21] Appl. No.: 09/129,681

[22] Filed: Aug. 6, 1998

[30] Foreign Application Priority Data

Aug. 7, 1997 [FR] France ..... 97.10359

[51] Int. Cl.[6] ..... A43B 5/04

[52] U.S. Cl. ..... 36/50.5

[58] Field of Search ..... 36/50.5, 50.1, 36/117.1; 24/68 SK, 69 SK, 70 SK, 71 SK

[56] References Cited

U.S. PATENT DOCUMENTS

| | | |
|---|---|---|
| 4,090,605 | 5/1978 | Olivieri . |
| 4,096,605 | 6/1978 | Annovi . |
| 5,551,174 | 9/1996 | Perrisoud . |

FOREIGN PATENT DOCUMENTS

| | | |
|---|---|---|
| 1941025 | 2/1971 | Germany . |
| 2414439 | 10/1975 | Germany . |
| 668682 | 1/1989 | Switzerland . |

*Primary Examiner*—Ted Kavanaugh
*Attorney, Agent, or Firm*—Greenblum & Bernstein, P.L.C.

[57] ABSTRACT

Tightening device adjustable on the adjustable parts of a boot in a direction transverse to that of the tightening force that it is capable of exerting by means of a tension lever. It has, on an adjustable part, a tension lever whose baseplate is adjustable in position in a transverse direction by a fastening means and a cutout, which cooperate, respectively, with a succession of fastening points and a boss. On the other adjustable part, a retaining element is guided in translation in a slot which extends parallel to the transverse direction of adjustment of the baseplate, located on the other adjustable part of the boot. The direction of the tightening force is allowed to be modified the direction of the tightening force to be applied on the adjustable parts of the boot.

12 Claims, 2 Drawing Sheets

Fig: 1
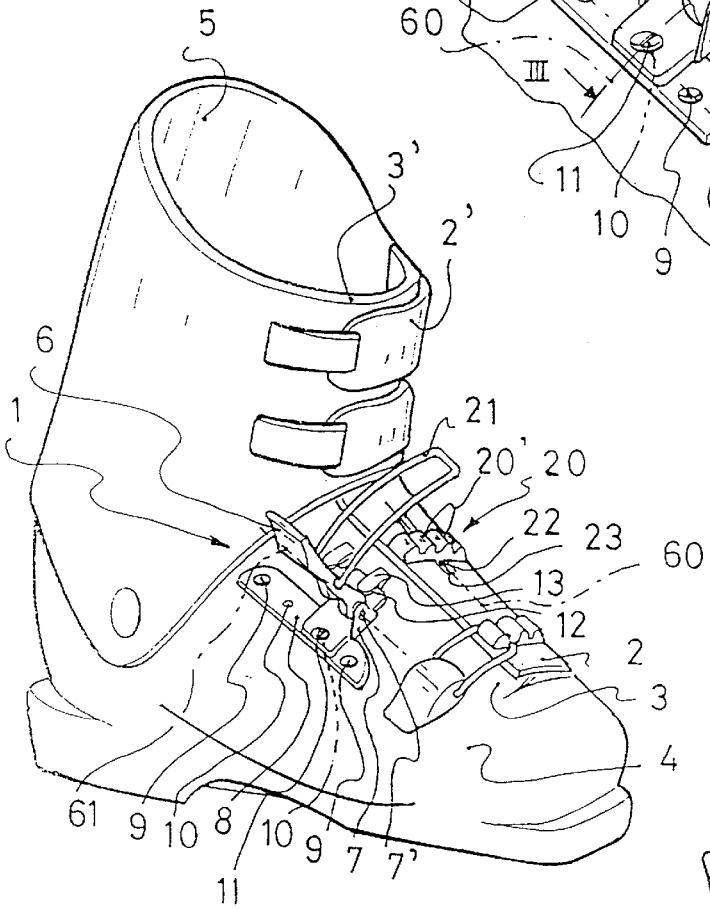
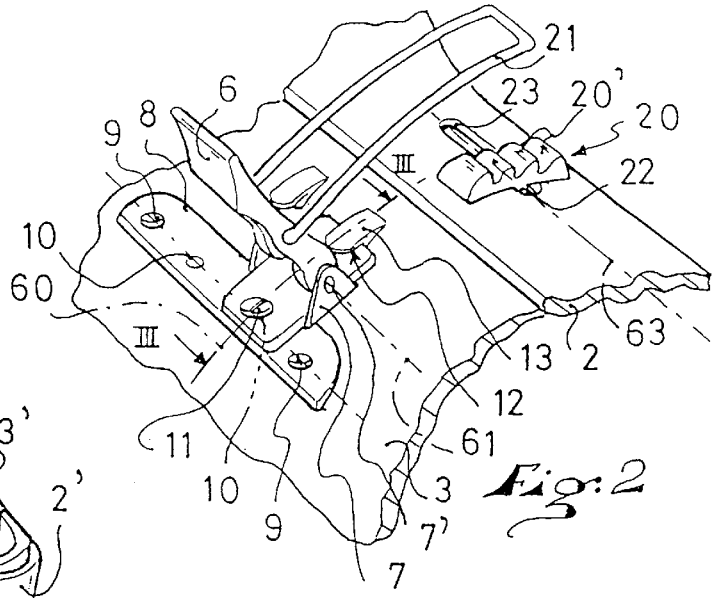
Fig: 2
Fig: 3
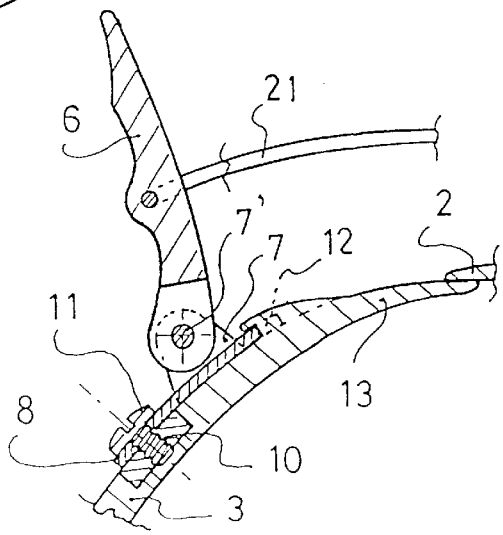

BOOT WITH TIGHTENING DEVICE

BACKGROUND OF THE INVENTION

1. Field of the Invention

The present invention relates to a tightening device for a boot adapted to bring two adjustable parts thereof closer together and relates more specifically to a tightening device that can be adjusted in position on these parts in a direction transverse to that of the tightening force that it is capable of exerting by means of a tension lever with which it is provided.

2. Description of Background and Relevant Information

Tightening devices of the aforementioned type are described in German Publication Nos. 19 41 025 and 24 14 439, as well as in Swiss Patent No. 668 682. In these tightening devices, the relative position of the elements constituting them and connecting the adjustable parts of the boot can be adjusted in view of modifying the direction of the tightening force to be applied on these adjustable parts, and in view of respecting the morphology of the user's foot.

More specifically, in the example of DE 24 14 439, a tightening device has a tension lever with a baseplate that is adjustable in an angular position on a rigid notched plate fixed by rivets on one of the adjustable parts of the boot in the area of the instep girth. This lever is adapted to pull on a tie whose ends are connected to the same adjustable part of the boot as that which has the lever. Between these two ends, the tie takes support on two fixed returns located on the other adjustable part of the boot, another lever ensuring the adjustment of the active length of the tie and the opening-closing of the upper of the boot. According to a construction feature, the returns of the tie are fixed in position, one in the area of the upper and the other in the area of the toe-end of the foot, and it is the adjusting of the tension lever position on the rigid plate which modifies the direction of the tightening force. This tightening device is consequently adjustable in position with respect to the adjustable parts of the boot due to the notched plate, in the direction transverse to that of the tightening force that it exerts by means of the tension lever, the resulting force being directed to the area of the instep girth.

As this appears from this construction, there is no effective pulling on the adjustable part of the boot extending opposite of the tension lever in the area of the instep girth. Furthermore, given that the tie is retained at its two ends on one of the adjustable parts of the boot, and that it takes support on the other adjustable part by means of two returns between which the tension lever operates, the tightening force that the latter can produce is reduced by about twice as much in the area of the upper and of the toe-end of the foot. Consequently, to obtain the right tightening force in these areas, it is necessary to apply a very substantial force on the tension lever in the area of the instep girth. Moreover, it is not possible to adjust the tightening force at a preferred area of the boot. Finally, such a tightening device is complicated given the high number of parts that it has for retaining the baseplate of the tension lever on the plate and of the parts that it must use to obtain the actual tightening.

In the example of DE 19 41 025, the tightening device has two rigid slides which extend substantially parallel to one another and which are each fixed by rivets on one of the adjustable parts of the boot. An articulated assembly having a tension lever, to which is tied an adjustable tie rod, is slidably mounted by sectional end pieces on the two slides thus connected to one another. The tightening device is therefore adjustable in position on the adjustable parts of the boot by means of slides in a direction transverse, even perpendicular, to that of the tightening force that it exerts by means of the tension lever. This type of tightening device allows for an effective pulling on the adjustable part of the boot which extends opposite of the tension lever, and allows adjusting the tightening force with respect to the morphology of the user's foot. However, given that the articulated assembly does not have any positive stopping means with respect to the slides, it is susceptible of sliding thereon as soon as it is opened. In reality, to avoid any loss of adjustment, it is necessary to reposition it on the slides after each opening operation. In addition, when the tightening force is relatively weak, the articulated assembly with its lever can have an ill-timed sliding along the slides, even when it is closed. This tightening device proves to be relatively complex given the numerous pieces to be implemented at the level of the articulated lever assembly to allow adjusting the tension, and difficult to obtain as it involves making very specific sectional slides.

One solution to the above-mentioned type of problem is described in Swiss Patent No. 668 682. Indeed, the tightening device described is adjustable in position on one of the adjustable parts of the upper of the boot, in a direction transverse to that of the tightening force that it exerts by a tension lever, by means of a rigid insert provided with several fastening points on which the baseplate of a locking tie rod secured to the lever is positively fixed. In this type of tightening device construction, it is possible to adjust the tightening force with respect to the morphology of the user's foot, without having to reposition it after each opening operation. However, since it is adjustable in position only on one of the adjustable parts of the upper, therefore asymmetrically adjustable, the tightening device imposes, on all of the adjustable part of the boot without the insert, a relatively substantial general elastic deforming especially when the end fastening points are used. In addition, the direction of the tightening force also varies, but in a direction opposite of that of the adjusting done on the insert, unlike the devices previously disclosed. Indeed, in this type of tightening device, when the highest fastening point is used on the upper of the boot, it is on the lower edge of the upper that the tightening force is mainly exerted. Inversely, in a position of use of the lowest fastening point, it is on the upper edge of the upper that the tightening force is the highest. In fact, this device allows above all adapting the adjustable parts of the upper of the boot to the morphology of the lower part of the user's leg between two end positions where the upper takes on a conical shape, whether widened towards the top or widened towards the bottom.

SUMMARY OF THE INVENTION

An object of the present invention is to allow an adjustment of the tightening device symmetrical to the adjustable parts of the boot without requiring a repositioning between the opening-closing operations, and by avoiding a substantial general deforming of at least one of the adjustable parts of the boot.

Another object of the invention is the provision of a tightening device with adjusting means in position that are simple and effective, compact and easy to make and implement.

To achieve these objectives, the tightening device adjustable in position on adjustable parts of a boot in a direction transverse to that of the tightening force that it is capable of exerting by means of a tension lever which it is provided, wherein the tension lever is mounted on a baseplate which is provided with, on the one hand, a dismountable fastening element adapted to retain it on any of the plurality of fastening points obtained in a rigid insert integral with one of the adjustable parts of the boot, and, on the other hand, an assembly means, such as a cutout, adapted to cooperate with a corresponding means, such as a boss, obtained on the adjustable part of the boot. These adjusting means constituted by the dismountable fastening element and by the cutout-boss cooperation allow solidly maintaining and fixing the baseplate of the tension lever in the selected position on the adjustable part of the boot. They are also easy to implement, since they only require a mere dismounting of the fastening element to change positions, the cooperation occurring automatically between the cutout and the boss as it involves a simple nesting.

In addition, the fastening element and the cutout of the baseplate of the tension lever are aligned in a direction coinciding approximately to that of the tightening force that the tension lever exerts, whereas the fastening points obtained in the insert successively extend in a direction transverse to that of the tightening force.

According to certain construction details, for each fastening point obtained in the insert, there is a corresponding boss on the adjustable part of the boot, and the rigid insert is, advantageously, at least partially inserted into the thickness of the wall of this adjustable part on which the insert is fixed. This at least partial insertion into the thickness of the wall of the adjustable part dispenses from having to use numerous rivets or other equivalent means for rigidly fixing the insert, for it allows distributing the pressures exerted on the insert over a larger area than that which would be offered by the rivets.

According to a preferred embodiment, the tension lever acts on a tie rod which cooperates with a retaining element which is adjustable in position on the other adjustable part of the boot. This retaining element is equipped with a guiding means which cooperates with a corresponding guiding means carried by the adjustable part of the boot so as to allow its adjusting in position of alignment opposite of the tension lever.

BRIEF DESCRIPTION OF DRAWINGS

The present invention also relates to the characteristics which will appear throughout the following description, with reference to the attached drawings showing, by way of example, different embodiments, in which:

FIG. 1 shows a sport boot, such as a ski boot, provided with a tightening device according to the invention;

FIG. 2 is an enlarged view of the tightening device from FIG. 1;

FIG. 3 shows, in a cross section taken along line III—III in FIG. 2, the tension lever of the tightening device with its baseplate relative to the insert and to the wall of the adjustable part of the boot on which it is retained;

DETAILED DESCRIPTION OF THE INVENTION

Figure 4:
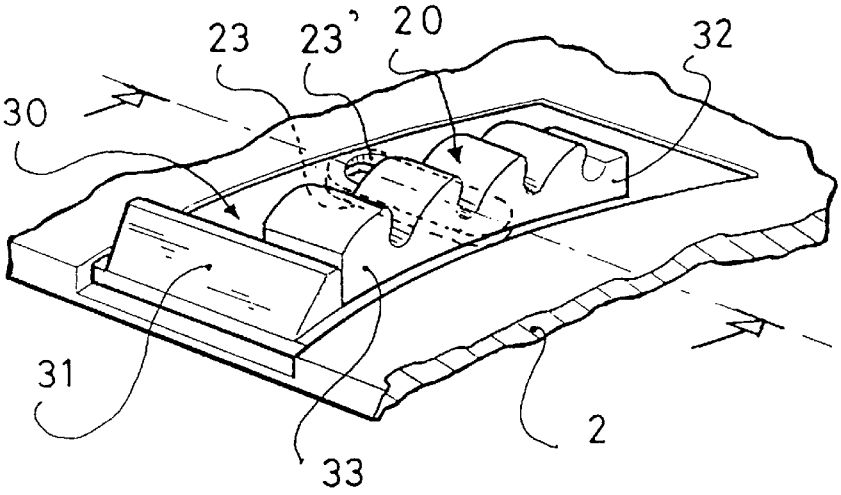
FIGS. 4 and 5 show an alternative embodiment of the mounting of the retaining element of the device from FIGS. 1 and 2 in which the tie rod of the tension lever cooperates.

The tightening device 1, generally designated in FIGS. 1 and 2, is adapted to bring closer together two adjustable parts 2 and 3 of the boot, which parts can be, as in this example, the closing flaps of the shell base 4. It is to be understood that the tightening device 1 can also be adapted to the closing flaps 2' and 3' of the upper 5 of the boot.

It has, on one adjustable part 3 of the boot, a tension lever 6 pivoting on one baseplate 7 about an axis 7' and a rigid mounting plater or insert 8 fixed by rivets 9. This rigid insert 8, in an elongated shape, is obtained with several fastening points 10, such as threaded holes in any one of which, selectively, a detachable fastening element 11 is adapted to be mounted so as to ensure the positive retaining of the baseplate 7 of the tension lever 6 in the area of the selected fastening point 10. The baseplate 7, which in fact forms a cap for the axis 7' of the lever 6, is provided on one side with the fastening element 11, and on the other side with an assembly member or means, such as a boss 13, obtained on the adjustable part 3, the boss 13 having a slot or cutout 12 for receiving therein a portion of the baseplate 7. According to a construction feature, the fastening element 11 and the cutout 12 are centered with respect to the cap constituted by the baseplate 7, and are aligned in a direction 60, shown in dotted lines, substantially perpendicular to the direction 61 of the pivoting axis 7' of the lever 6.

Consequently, their alignment coincides approximately with the direction of the tightening force that the tension lever 6 can exert, i.e., the direction 60 in the example described. In order to allow the adjusting of the position of the lever 6 on the adjustable part 3 of the boot in a direction transverse to that of the tightening force that it is capable of exerting, more specifically parallel to the direction 61 of its axis 7' of the pivoting lever 6, the fastening points 10 of the insert 8 are also arranged parallel to the direction 61 of the axis 7'. Of course, there are as many bosses 13, with slots 12, obtained as there are fastening points 10, and the bosses 13 are also aligned on this transverse direction, parallel to the fastening points 10.

The tightening device 1 also has, on the other adjustable part 2 of the boot, a retaining element 20 adjustable in position, with which cooperates a bail or tie rod 21 connected to the tension lever 6. This retaining element is constituted by a rack whose notches 20' allow varying the locking position of the tie rod 21, and consequently varying the tightening force that the tension lever 6 can exert on the two adjustable parts 2 and 3 of the boot. In order to allow a symmetrical adjusting of the tightening position 1 on these two adjustable parts 2 and 3 of the boot, and in particular in order to align the retaining element 20 with the tension lever 6, the retaining element 20 is also provided to be transversely adjustable.

To this end, it is provided with a guiding means element 22, constituted by a plug which cooperates with a corresponding guiding means 23 formed by an oblong slot. The plug 22 is freely slidably mounted into the oblong slot 23 which extends transversely in a direction 63, shown in dotted lines, substantially parallel to the direction 61 of the axis 7' of the lever 6 and of the fastening points 10 of the insert 8. Due to these arrangements, the retaining element 20 can therefore be easily placed opposite the tension lever 6 without causing the deforming of the adjustable part 2 of the boot on which it is slidably mounted.

According to an embodiment detail, shown in FIG. 3, the insert 8 is at least partially inserted into the thickness of the adjustable part 3 of the boot. This arrangement allows distributing over a large area the pressures exerted on the insert 8 when the tension lever 6 is implemented, and also allows integrating at least a part of the constituent pieces of the tightening device 1 in the general exterior volume of the boot.

Given that the tightening force that the tightening device 1 can exert may be high, risks of deterioration of the pieces or the parts locally subjected to high pressures are susceptible of appearing. That is precisely what is susceptible of happening in the area where the retaining element 20 slides on the adjustable part 3 of the boot, which is generally obtained in a relatively flexible material to ensure its function of closing and adapting to the morphology of the user's foot.

Figure 5:
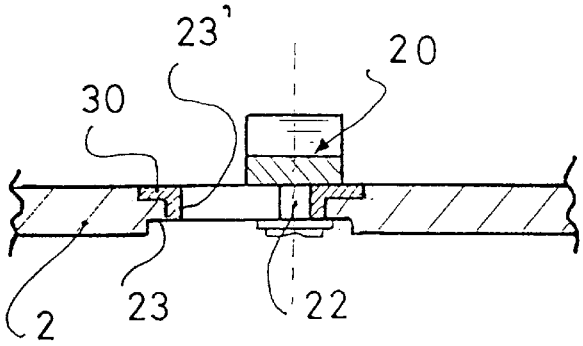

To prevent this type of incident, it is therefore advantageously envisioned to use reinforcement elements adapted to cover the parts or pieces which show a certain fragility. Consequently, in the embodiment example shown by FIGS. 4 and 5, a resistant piece 30 covers the guiding means 23, i.e., the oblong slot. This piece can come from an insert molded together with the adjustable part 2 of the boot or attached and fixed thereto, for example, by welding, gluing, etc. Obviously, in this type of construction, the plug 22 that constitutes the guiding means for the rack 20 is then adjusted to the predetermined oblong slot 23' on the piece 30. This plug 22 located at the rear end 32 of the rack 20 can be provided to be cylindrical so as to allow the latter to turn on it to align itself very precisely with the tension lever 6, especially when the transverse adjustment is done with a certain approximation. In fact, according to a preferred embodiment, the rack 20 is not envisioned to be pivotally mounted but rather maintained and guided in translation on the resistant piece 30. To this end, the resistant piece 30 is equipped with a guiding area 31, such as a shoulder, parallel to the oblong slot 23', along which the front end 33 of the rack 20, which constitutes a complementary guiding area, slides.

Figure 6:
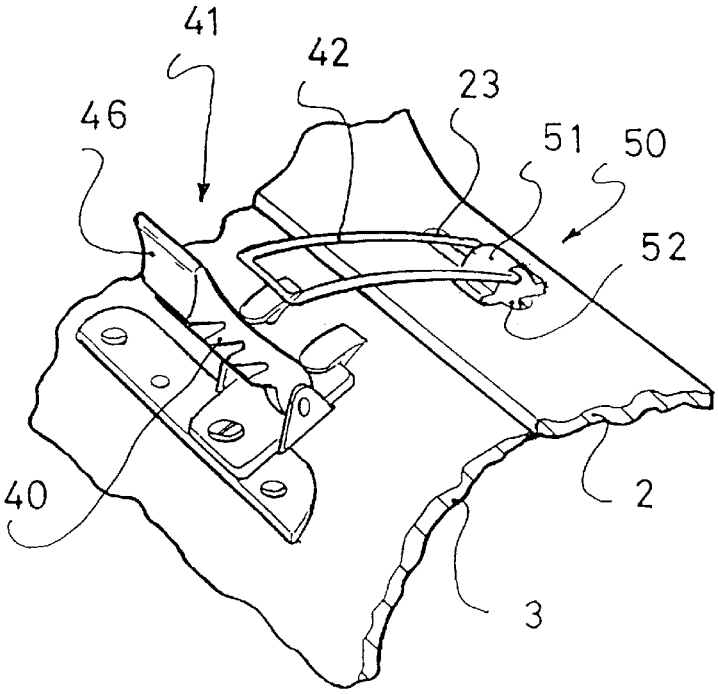
FIG. 6 shows another embodiment of the tightening device.

It is to be understood that the component parts of the tightening device 1 can be obtained and/or arranged differently than that which was just described. By way of example, as shown in FIG. 6, the tightening device 41 has a tension lever 46, provided with a rack 40, whereas the retaining element 50 is provided with a tie rod 42. In this construction, the rack, which was previously on the retaining element, was simply transferred on the tension lever, and the tie rod which was on the lever was transferred on the retaining element 50. The latter element 50 is obtained in the shape of a mushroom whose cap 51, positioned to project on the corresponding adjustable part 2 of the boot, is provided with the tie rod 42 activated by the tension lever 46 and whose stem, 52, equivalent of the plug 22 of the preceding retaining element 20, is slidably mounted into the oblong slot 23. The description of the assembly including the lever 46 with its fixation on the adjustable part 3 of the boot is not repeated because all of the preceding features disclosed in reference to FIGS. 1–5 are unchanged.

The instant application is based upon the French priority patent application No. 97.10359 filed on Aug. 7, 1997, the disclosure of which is hereby incorporated by reference thereto in its entirety, and the priority of which is hereby claimed under 35 USC 119.

What is claimed is:

1. A boot comprising:

two relatively adjustable parts;

a tightening device for applying a tightening force to said two relatively adjustable parts of the boot in a determinate direction, said tightening device being adjustable in a direction transverse to said determinate direction, said tightening device comprising:

a rigid insert fixed to one of said two parts of the boot, said insert having a plurality of discrete fastening points extending in said transverse direction;

a baseplate;

a fastening element for retaining said baseplate in any one of said plurality of fastening points with respect to said rigid insert and enabling an adjustment of position of said baseplate at any of said fastening points;

a plurality of discrete assembly members extending in said transverse direction spaced from said plurality of fastening points, said baseplate being engaged by one of said assembly members while being retained by one of said fastening elements;

respective pairs of said fastening points and said assembly members being aligned approximately in said tightening force direction, in each position of adjustment of said baseplate; and a tensioning lever mounted for movement on said baseplate, said tensioning lever having a portion for manipulation for exertion of said tightening force.

2. A boot according to claim 1, wherein:

said assembly members comprise a plurality of bosses on said one of said two parts of the boot which cooperate with respective cutouts for engaging said baseplate.

3. A boot according to claim 2, wherein:

for each fastening point of said rigid insert a corresponding boss is positioned on said one of said two adjustable parts of the boot.

4. A boot according to claim 1, wherein:

said one of said two relatively adjustable parts of said boot has a certain thickness;

said rigid insert is at least partially inserted into said thickness of said adjustable part.

5. A boot according to claim 1, wherein:

a retaining element is adjustable in position on a second of said two relatively adjustable parts of the boot in a direction transverse to said direction of the tightening force exerted by said tension lever; and a tie rod is connected to said tensioning lever, whereby said tensioning lever acts on said tie rod, as said tie rod cooperates with said retaining element.

6. A boot according to claim 5, wherein:

said retaining element with which said tie rod cooperates comprises a guide which cooperates with a corresponding guide carried by said second adjustable part of the boot, so as to allow adjustment in an alignment position opposite of said tensioning lever.

7. A boot according to claim 6, wherein:

said guide carried by said second adjustable part of the boot is constituted by an oblong slot extending in a direction transverse to that of the tightening force exerted by said tensioning lever; and a plug extends from said retaining element, freely slidably mounted in said oblong slot, constitutes said guide of said retaining element.

8. A boot to claim 7, wherein:

said guide carried by said second adjustable part of the boot comprises a resistant piece covering and reinforcing said second adjustable part of the boot.

9. A boot according to claim 6, wherein:

said retaining element comprises a rack, said tie rod of said tensioning lever cooperating with said rack, a plug extending from said rack plug, said plug being slidably mounted in said oblong slot.

10. A boot according to claim 9, wherein the retaining element of the tie rod comprises a guiding area which cooperates with a complementary area located on the corresponding adjustable part of the boot, these guiding areas being oriented parallel to the oblong slot.

11. A boot according to claim 6, wherein:

said retaining element has a mushroom shape with a cap and a stem, said cap being positioned to project from said second adjustable part of the boot and being provided with a tie rod, activated by said tensioning lever, and said stem being slidably mounted in said oblong slot.

12. A boot comprising:

two relatively adjustable parts;

a tightening device for applying a tightening force to said two relatively adjustable parts of the boot in a determinate direction, said tightening device being adjustable in a direction transverse to said determinate direction, said tightening device comprising:

a rigid mounting plate fixed to one of said two relatively adjustable parts of the boot, said mounting plate having a plurality of discrete fastening points extending in said transverse direction;

a baseplate;

a tensioning lever mounted for movement on said baseplate, said tensioning lever having a manipulation portion for exertion of said tightening force in said determinate direction;

an adjustment assembly to secure said baseplate to said rigid mounting plate in any of said plurality of discrete fastening points, while maintaining said determinate direction of said tightening force constant; and at least one retaining element positioned on a second of said two relatively adjustable parts of the boot and a mounting arrangement for enabling transverse adjustment of said retaining element for alignment with said adjustment assembly in any of said plurality of discrete fastening points;

a bail connected to said tensioning lever, said bail being adapted to be secured to said retaining element for applying said tightening force to said retaining element and, thereby, between said two relatively adjustable parts of the boot.

* * * * *